US007717766B2

(12) United States Patent
Watanabe et al.

(10) Patent No.: US 7,717,766 B2
(45) Date of Patent: May 18, 2010

(54) FLUORESCENT LAMP AND METHOD OF MANUFACTURING FLUORESCENT LAMP

(75) Inventors: Hiroto Watanabe, Fukushima (JP); Takeshi Kaneko, Kanagawa (JP)

(73) Assignee: Sony Corporation, Tokyo (JP)

( * ) Notice: Subject to any disclaimer, the term of this patent is extended or adjusted under 35 U.S.C. 154(b) by 368 days.

(21) Appl. No.: 11/392,979

(22) Filed: Mar. 28, 2006

(65) Prior Publication Data

US 2006/0214551 A1 Sep. 28, 2006

(30) Foreign Application Priority Data

Mar. 28, 2005 (JP) ..... 2005-092152

(51) Int. Cl.
*H01J 9/00* (2006.01)

(52) U.S. Cl. ..... 445/26

(58) Field of Classification Search ..... 445/26, 445/25; 313/318.01

See application file for complete search history.

(56) References Cited

U.S. PATENT DOCUMENTS

| | | | | |
|---|---|---|---|---|
| 4,093,893 | A * | 6/1978 | Anderson | 315/48 |
| 5,229,687 | A * | 7/1993 | Fowler et al. | 313/565 |
| 5,629,716 | A * | 5/1997 | Okamoto et al. | 345/60 |
| 5,739,879 | A * | 4/1998 | Tsai | 349/62 |
| 6,342,763 | B1 * | 1/2002 | Fukushima et al. | 313/623 |
| 6,597,105 | B1 * | 7/2003 | Oga et al. | 313/490 |
| 2004/0232815 | A1 * | 11/2004 | Tomiyoshi et al. | 313/318.1 |

FOREIGN PATENT DOCUMENTS

| | | | |
|---|---|---|---|
| JP | 57-123630 | | 8/1982 |
| JP | 61-071954 | U | 5/1986 |
| JP | 62-012045 | A * | 1/1987 |
| JP | 01-097347 | | 4/1989 |
| JP | 07-272674 | A | 10/1995 |
| JP | 2003-151438 | A | 5/2003 |
| WO | WO 2004073012 | A1 * | 8/2004 |

* cited by examiner

*Primary Examiner*—Toan Ton
*Assistant Examiner*—Hana A Sanei
(74) *Attorney, Agent, or Firm*—Wolf, Greenfield & Sacks, P.C.

(57) ABSTRACT

A fluorescent lamp 1 is constructed in which more than two lead wires (5), (6), (11) and (12) are connected to respective electrodes (3) and (4) of both end portions of a glass tube (2), the glass tube (2) having a uniform diameter of less than 6.5 mm. Also, when the fluorescent lamp 1 is manufactured, an electrode assembly in which two glass beads are fixed to more than two lead wires extended from the electrodes, mercury amalgam being welded to the lead wires is used, the electrode assembly is temporarily fastened by welding the inside glass bead to the glass tube, mercury is evaporated by heating the mercury amalgam and the inside of the glass tube is sealed by welding the outside glass bead to the glass tube.

2 Claims, 5 Drawing Sheets

11
12
13
14
15
21
22
23
24

FLUORESCENT LAMP AND METHOD OF MANUFACTURING FLUORESCENT LAMP

CROSS REFERENCES TO RELATED APPLICATIONS

The present invention contains subject matter related to Japanese Patent Application JP 2005-092152 filed in the Japanese Patent Office on Mar. 28, 2005, the entire contents of which being incorporated herein by reference.

BACKGROUND OF THE INVENTION

1. Field of the Invention

The present invention relates to a fluorescent lamp such as a hot cathode fluorescent lamp and a method of manufacturing a fluorescent lamp.

2. Description of the Related Art

It has been customary to use a fluorescent lamp using a fluorescent material as a light source.

In particular, since a hot cathode type fluorescent lamp is high in luminous efficiency and brightness, it is used not only as a light source for illumination apparatus but also as a backlight of a liquid-crystal display (LCD).

The hot cathode type fluorescent lamp has an arrangement in which electrodes are provided at respective ends of a glass tube, a gas such as an Ar (argon) gas and mercury are sealed into a space within the glass tube, a fluorescent material being coated on the inner surface of the glass tube (see Cited Patent Reference 1, for example).

[Cited Patent Reference 1]: Official Gazette of Japanese laid-open patent application No. 5-251042

FIG. 1 of the accompanying drawings is a schematic diagram showing an arrangement of one end portion of a fluorescent lamp according to the related art.

Since the related-art fluorescent lamp uses an exhaust pipe to exhaust the inside of the fluorescent lamp upon manufacturing, as shown in FIG. 1, an exhaust pipe 102 still remains in the finished fluorescent lamp 101.

Further, since a lead wire 104 connected to an electrode 3 such as a coil should be provided independently of the exhaust pipe 102, it is not possible to decrease a diameter D of the fluorescent lamp 101.

For this reason, this fluorescent lamp according to the related art may not be applied to a narrow frame type backlight of backlights.

Further, since a diameter d of the exhaust pipe 102 is considerably smaller than the diameter D of the fluorescent lamp 101 (D>d), if the diameter of the exhaust pipe 102 is decreased, then it is frequently observed that conductance of exhaustion will be extremely lowered or that it will become impossible to use the exhaust pipe 102.

SUMMARY OF THE INVENTION

In view of the aforesaid aspects, the present invention intends to provide a fluorescent lamp which can realize a fluorescent lamp of which diameter is small and a method of manufacturing a fluorescent lamp.

According to an aspect of the present invention, there is provided a fluorescent lamp which is comprised of a glass tube having electrodes provided at its respective end portions and more than two lead wires connected to the respective electrodes, wherein the glass tube has a uniform diameter of less than 6.5 mm.

According to the above-mentioned present invention, since the glass tube is made uniform in diameter and the glass tube has no exhaust pipe provided at its end portion, it is possible to decrease the diameter of the glass tube. Also, it is possible to decrease the ineffective light emission length of the fluorescent lamp.

Then, since the glass tube has the diameter of less than 6.5 mm, it is possible to construct a thin fluorescent lamp.

According to another aspect of the present invention, there is provided a method of manufacturing a fluorescent lamp which is comprised of the steps of using an electrode assembly in which more than two lead wires are connected to electrodes, two glass beads being fixed to the more than two lead wires extended from the electrodes side by side in the direction extending along the lead wires, welding mercury amalgam to at least one of the lead wires between the two glass beads, exhausting the inside of the glass tube after the lead wires of the electrode assembly were inserted into the glass tube, sealing the inside of the glass tube by welding a glass bead, near the end portion of the glass tube, of the two glass beads to the glass tube, evaporating mercury by heating the mercury amalgam and sealing the inside of the glass tube by welding a glass bead, near the inside of the glass tube, of the two glass beads to the glass tube.

According to the above-mentioned present invention, since the electrode assembly in which the two glass beads are fixed to more than two lead wires extended from the electrode side by side in the direction extending along the lead wires is used and the inside of the glass tube is exhausted after the lead wires of the electrode assembly were inserted into the glass tube, it is possible to exhaust the inside of the glass tube without providing the exhaust pipe.

Also, since the glass bead, near the end portion of the glass tube, of the two glass beads is welded to the glass tube to seal the inside of the glass tube and the mercury is evaporated by heating the mercury amalgam, in this state, the mercury amalgam remains within the sealed space. Consequently, although the thus evaporated mercury is entered into the inside of the glass tube from the gap between one glass bead and the glass tube, it can be prevented from being leaked to the outside.

Further, since the glass bead, near the inside of the glass tube, of the two glass beads is welded to the glass tube to seal the inside of the glass tube, it is possible to seal the glass tube reliably.

According to the above-mentioned fluorescent lamp of the present invention, the exhaust pipe has no convex portion provided thereon, the ineffective light emission length of the fluorescent lamp can be decreased, and the ineffective light emission length can be decreased when the fluorescent lamp according to the present invention is applied to a backlight.

Also, since the fluorescent lamp according to the present invention has no exhaust pipe provided thereon, exhaust efficiency can be prevented from being lowered. When a fluorescent lamp is manufactured, the inside of the glass tube can be exhausted in a short period of time and hence productivity can be improved.

Then, it is possible to decrease the diameter of the fluorescent lamp.

Also, according to the manufacturing method of the present invention, since the inside of the glass tube can be exhausted without providing the exhaust pipe, it becomes possible to manufacture the fluorescent lamp having the small diameter.

DESCRIPTION OF THE PREFERRED EMBODIMENTS

The present invention will now be described in detail with reference to the drawings.

Figure 1:
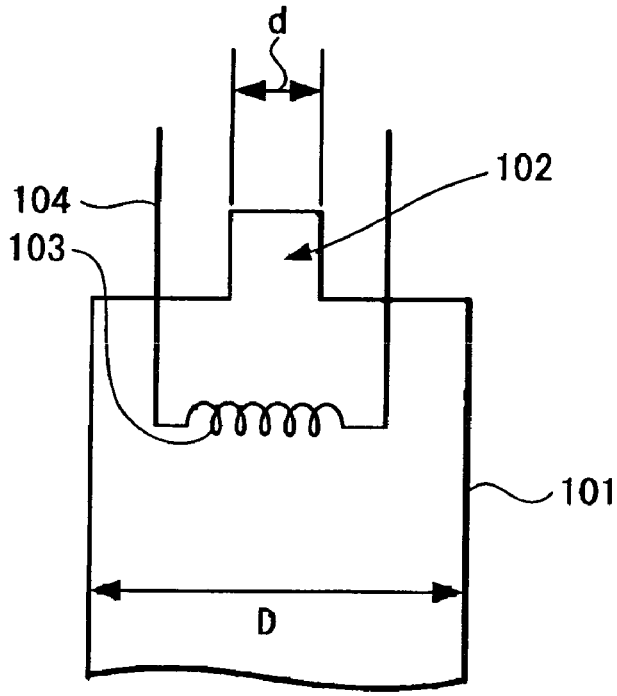
FIG. 1 (RELATED ART)
FIG. 1 is a schematic diagram showing an arrangement of one end portion of a fluorescent lamp according to the related art.
Figure 2:
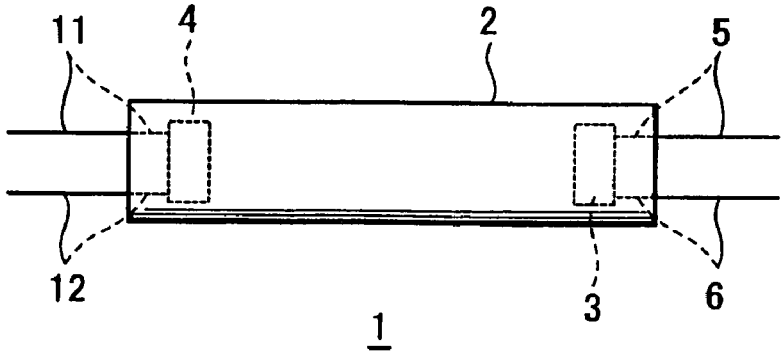
FIG. 2 is a schematic diagram showing an arrangement of a fluorescent lamp according to an embodiment of the present invention.

FIG. 2 is a schematic diagram showing an arrangement of a fluorescent lamp according to an embodiment of the present invention.

As shown in FIG. 2, this fluorescent lamp 1 includes a narrow and thin glass tube 2 having electrodes 3 and 4 provided at respective end portions of the glass tube 2. Two lead wires 5 and 6 connected to the electrode 3 of the right end portion and two lead wires 11 and 12 connected to the electrode 4 of the left end portion are extended to the outside of the glass tube 2.

A fluorescent material layer 2A (see FIG. 3) is formed on the inner surface of the glass tube 2.

Also, a rare gas such as an Ar (argon) gas and a Ne (neon) gas and mercury (Hg), which is a luminescent substance, are sealed into the inside of the glass tube 2.

The two electrodes 3 and 4 are coated with an electron radioactive material.

Figure 3:
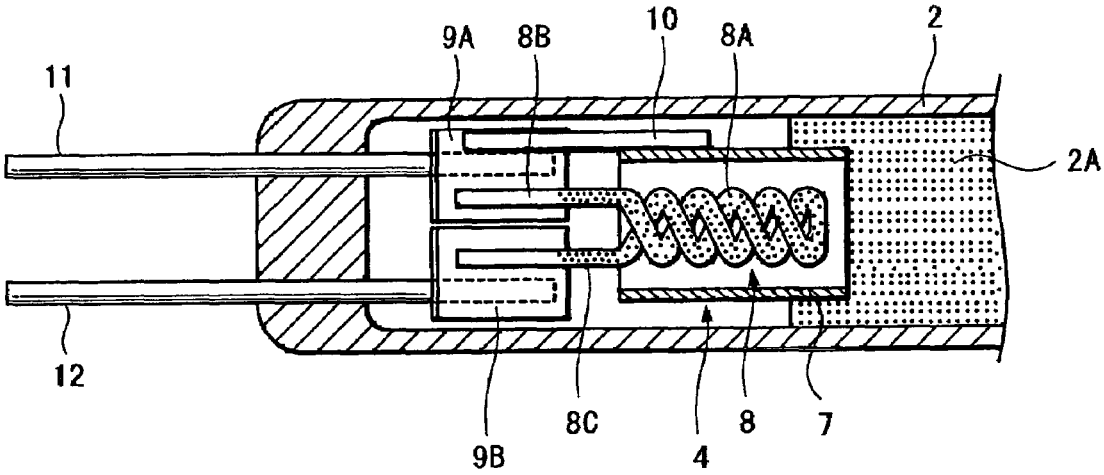
FIG. 3 is a diagram showing components near the electrode of the left end portion shown in FIG. 2 in an enlarged-scale.

FIG. 3 is a diagram showing components provided near the electrode 3 at the left end portion of the fluorescent lamp 1 shown in FIG. 2 in an enlarged-scale.

As shown in FIG. 3, the electrode 4 includes a heater 8 composed of a coil portion 8A and a first lead portion 8B and a second lead portion 8C, both of which are connected to this coil portion 8A. The heater 8 is made of a suitable wire material such as tungsten (W) or rhenium tungsten (Re—W).

The heater 8 includes the coil portion 8A of a substantially cylindrical shape which is obtained by winding spiral windings of a wire material in a double or triple spiral shape so that the wire materials may not be contacted with each other. Further, the two lead portions 8B and 8C are extended from the rear end of the coil portion 8A.

Also, the heater 8 is covered with an electron radioactive material, for example, ternary alkali earth metal oxide made of barium (Ba), strontium (Sr) and calcium (Ca).

The electron radioactive material is not limited to the above-mentioned ternary alkali earth metal oxide, and other materials such as binary barium oxide may be used as the electron radioactive material.

Since the heater 8 has the double or triple spiral structure, the long wire material becomes necessary to form the coil portion 8A so that the surface area of the coil portion 8A can be increased. Accordingly, the quantity of the electron radioactive material coated on the coil portion 8A can be increased, which can prolong the life span of the electrode 4.

A wire material having a diameter ranging of from approximately 25 μm to 70 μm is available as the wire material to form the heater 8. It is desirable that the wire material should have a diameter ranging of from approximately 45 μm to 55 μm, for example, so that the wire material may become easy to wind when the heater 8 has the double spiral structure and that sufficient strength may be maintained.

As shown in FIG. 3, the electrode 4 is provided with a first heater tab 9A and a second heater tap 9B to support the heater 9. The rear end side of the first lead portion 8B of the heater 8 is joined to the first heater tab 9A by welding, and the rear end side of the second lead portion 8C of the heater 8 is jointed to the second heater tab 9B by welding.

The first and second heater tabs 9A and 9B may be made of a plate material such as a stainless steel (SUS304).

The electrode 4 is connected through the first heater tab 9A and the second heater tab 9B to lead wires 11 and 12, respectively. The lead wires 11 and 12 are substantially parallel to each other and they are passed through the end portion of the glass tube 2 from the outside to the inside.

The first heater tab 9A is joined to the lead wire 11 at its tip end side of the portion extended into the inside of the glass tube 2 by welding. The second heater tab 9B is joined to the lead wire 12 at its tip end side of the portion extended into the side of the glass tube 2 by welding.

As described above, the electrode 4 supported with the lead wires 11 and 12 has a vertical arrangement in which the coil portion 8A of the heater 8 may be extended along the tube axis of the glass tube 2. As a result, ions generated by discharging are mainly bombarded against the tip end of the coil portion 8A so that the electron radioactive material is difficult to scatter on the side surface of the coil portion 8A due to bombardment of ions.

Also, since the electrode 4 supports the heater 8 to the lead wires 11 and 12 by the two lead wires 8B and 8C extended from the rear end side of the coil portion 8A, no tension is applied to the heater 8 and hence breaking of wires is difficult to occur.

Further, as shown in FIG. 3, the electrode 4 is provided with a sleeve 7 to prevent the electron radioactive material from being scattered and evaporated. The sleeve 7 is an example of a scattering preventing member. The sleeve 7 is made of a suitable material such as nickel (Ni) and molybdenum (Mo) and it is shaped like a cylinder of which respective ends are opened.

The sleeve 7 is inserted into the inside of the heater 8 in such a manner that the coil portion 8A of the heater 8 may become substantially parallel to the sleeve 7. Then, the sleeve 7 is attached to the first heater tab 9A by a sleeve lead 8, whereby the sleeve 7 covers the circumference of the coil portion 8 in the state in which the tip end side and the rear end side of the coil portion 8A are opened.

The sleeve lead 10 is made of a stainless steel (SUS304) similarly to the first and second heater tabs 9A and 9B. Also, the sleeve lead 10 may be secured to the second heater tab 9B.

The inner diameter of the sleeve 7 is larger than the outer diameter of the coil portion 8A of the heater 8 so that the coil portion 8A can be prevented from contacting with the sleeve 7 when the coil portion 8A of the heater 8 is inserted into the inside of the sleeve 7 in direction substantially parallel to the sleeve 7.

Also, the outer diameter of the sleeve 7 is smaller than the inner diameter of the glass tube 2 so that the sleeve 7 and the glass tube 2 can be prevented from contacting with each other.

Further, the sleeve 7 is attached to the heater 8 in such a positional relationship that the tip end portion of the coil portion 8A may not be projected from an open end face of the sleeve 7. While the sleeve 7 and the heater 8 should preferably be set to such a positional relationship that the tip end portion of the coil portion 8A may lie in the inside of the open end face of the sleeve 7, it is also possible that the open end face of the sleeve 7 and the tip end portion of the coil portion 8A may become flush with each other.

Also, the sleeve 7 is longer than the coil portion 8A and the whole of the side surface of the coil portion 8A is covered with the sleeve 7.

A coated range of the fluorescent material layer 2A on the inner surface of the glass tube 2 is limited up to position that is slightly outside of the open end face of the sleeve 7 of the electrode 4. This coated range of the fluorescent material layer 2A becomes a light-emitting portion of the fluorescent lamp 1.

In the fluorescent lamp 1 according to this embodiment, in particular, the diameter of the glass tube 2 is uniform and the diameter of the glass tube 2 is selected to be less than 6.5 mm.

As a consequence, the glass tube 2 has no exhaust pipe provided at its end portion and therefore it is possible to decrease the diameter of the glass tube 2. Also, it is possible to decrease an ineffective light emission length of the fluorescent lamp 1.

Then, since the diameter of the glass tube 2 is less than 6.5 mm, it is possible to construct the thin fluorescent lamp 1.

More preferably, the diameter of the glass tube 2 should be made as small as about 2 mm to 3 mm.

Next, operations of the fluorescent lamp 1 according to this embodiment will be described.

First, a voltage of about 5V, for example, is applied to the respective electrodes 3 and 4 to enable the heater 8 to heat the electron radioactive material. Then, a voltage of 300V, for example, is applied to the two electrodes 3 and 4 at a high frequency through the lead wires 5, 6 and 11, 12. As a result, electrons are emitted from the electron radioactive material to cause arc discharge to occur between the electrodes 3 and 4. After the arc discharge occurred between the electrodes 3 and 4, a voltage of about 100V, for example, is applied to the two electrodes 3 and 4 and a voltage of about 2V is applied to the two electrodes 3 and 4 under control.

Electrons accelerated after they were emitted from the electron radioactive material strike mercury electrons to excite mercury electrons. The thus excited mercury electrons emit ultraviolet ray and this ultraviolet ray is converted into visible light by the fluorescent material of the fluorescent material layer 2A to thereby energize the fluorescent lamp 1 to emit light.

Although ions generated during discharging strike the electrodes 3 and 4 to cause the electron radioactive material to scatter, since the coil portion 8A is disposed in the longitudinal direction extending along the tube axis of the glass tube 2, ions mainly strike the tip end portion of the coil portion 8A. As a result, scattering of the electron radioactive material may be suppressed at most of the side surface of the coil portion 8A.

Also, since the coil portion 8A is inserted into the sleeve 7 and the open end face of the sleeve 7 is projected from the tip end portion of the coil portion 8A, ion bombardment on the tip end portion of the coil portion 8A can be decreased. As a result, exhaustion of the electron radioactive material can be suppressed for a long period of time.

Accordingly, since the electrodes 3 and 4 can emit electrons for a long period of time, the life spans of the electrodes 3 and 4 can be prolonged.

Further, when the fluorescent lamp 1 is not provided with the sleeve 7, the evaporated electron radioactive material may be vapor-welded on the inner surface of the glass tube 2.

On the other hand, according to the embodiment of the present invention, since the coil portion 8A is inserted into the sleeve 7, the electron radioactive material evaporated from the heater 8 is vapor-welded on the inner surface of the sleeve 7. Then, when the heater 8 is energized, the sleeve 7 also is heated to cause electrons to be emitted from the electron radioactive material welded on the inner surface of the sleeve 7. As a consequence, it is possible to prolong the life spans of the electrodes 3 and 4.

Because the life spans of the electrodes 3 and 4 can be prolonged as described above, it is possible to prolong the life span of the fluorescent lamp 1.

Also, since the heater 8 is inserted into the sleeve 7, the heater 8 can be heated up to a desired temperature at a low voltage by thermal radiation. For example, it is possible to lower a voltage, which is applied in order to preheat the heater 8, from approximately 5V to approximately 3V.

Next, a method of manufacturing the fluorescent lamp 1 shown in FIG. 2 will be described as a method of manufacturing a fluorescent lamp according to the embodiment of the present invention.

Figure 4:
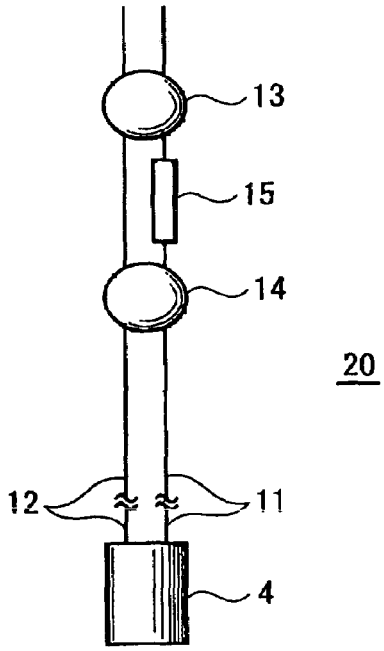
FIG. 4 is a schematic diagram showing an arrangement of an electrode assembly for use in manufacturing the fluorescent lamp shown in FIG. 2.

In this embodiment, there is used an electrode assembly 20 having an arrangement shown in FIG. 4.

As shown in FIG. 4, this electrode assembly 20 has an arrangement in which two glass beads 13 and 14 are welded to two lead wires 11 and 12 connected to the electrode 4.

The two glass beads 13 and 14 are welded side by side in the direction extending along the two lead wires 11 and 12.

Also, the lead wires 11 and 12 are spaced apart from each other by a constant space so as not to contact with each other.

Further, a mercury amalgam 15 is welded to the two glass beads 13 and 14 of one lead wire 11.

Subsequently, a method of manufacturing this electrode assembly 20 will be described with reference to FIGS. 5A to 5G. In FIGS. 5A to 5G, the electrode 4 which is connected to one end side of the lead wires 11 and 12 is not shown.

Figures 5A, 5B, 5C, 5D, 5E, 5F, 5G:
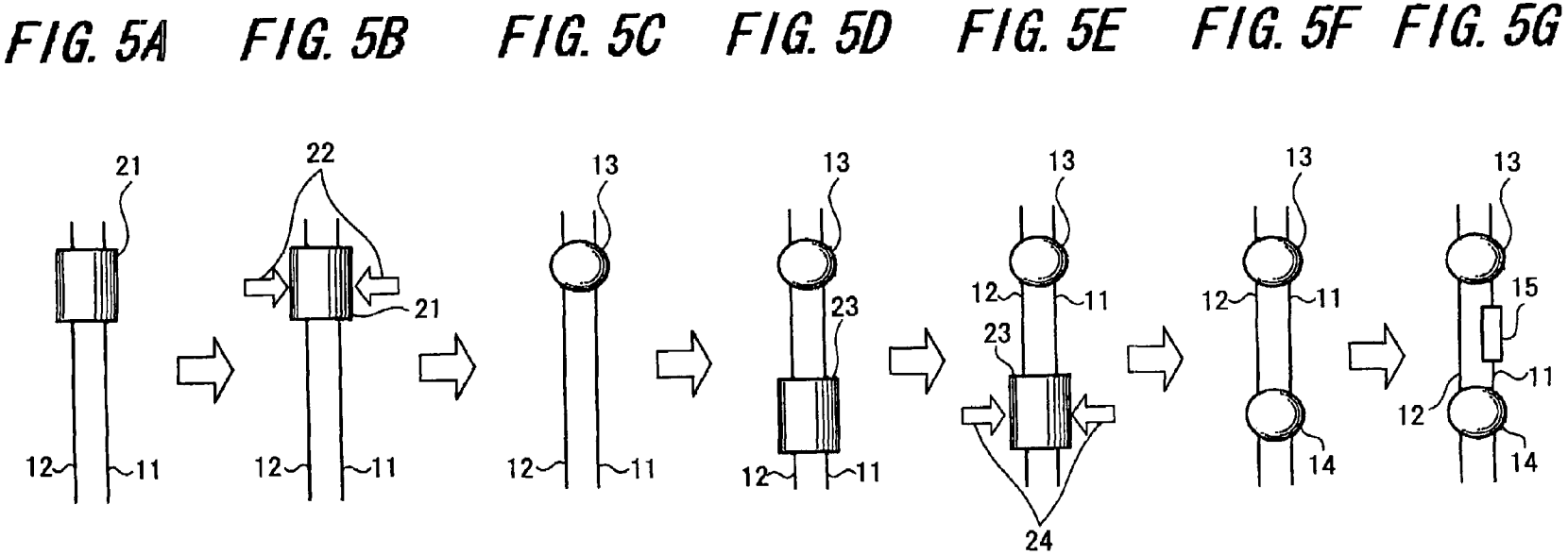
FIGS. 5A to 5G are diagrams to which reference will be made in explaining a method of manufacturing a lead wire with glass beads shown in FIG. 4.

First, as shown in FIG. 5A, the electrode 4 (see FIG. 4) is connected to the one end side of the lead wires 11 and 12 and a glass tube 21 having a circular cylinder shape is inserted into the two lead wires 11 and 12 which are spaced apart from each other by a constant space.

Next, as shown in FIG. 5B, the glass tube 21 is welded on the lead wires 11 and 12 by heating the glass tube 21 as shown by open arrows 22, whereby the first glass bead 13 welded to the two lead wires 11 and 12 is formed as shown in FIG. 5C.

Subsequently, as shown in FIG. 5D, a glass tube 23 is inserted into the lead wires 11 and 12 of the portion distant from the first welded first glass bead 13 by a constant space.

Next, as shown in FIG. 5E, the glass tube 23 is welded on the lead wires 11 and 12 by heating the glass tube 23 as shown by open arrows 24, whereby the second glass bead 14 welded to the two lead wires 11 and 12 is formed as shown in FIG. 5F.

After that, as shown in FIG. 5G, a mercury amalgam 15 is welded or attached to the two glass beads 13 and 14 of one lead wire 11. At that time, it is to be appreciated that the mercury amalgam 15 may be prevented from contacting with the other lead wire 12.

In this manner, it is possible to manufacture the electrode assembly 20 shown in FIG. 4.

Subsequently, a method of manufacturing the fluorescent lamp 1 shown in FIG. 2 by using the electrode assembly 20 shown in FIG. 4 will be described.

Figure 6A:
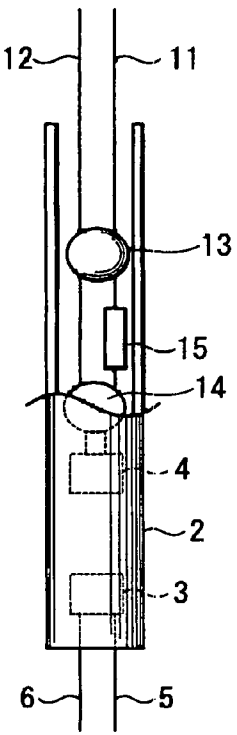
FIGS. 6A to 6J are process diagrams showing a method of manufacturing the fluorescent lamp shown in FIG. 2.
Figure 6B:
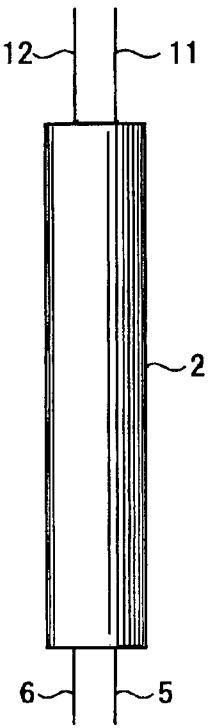

First, as shown in FIG. 6A, the electrode assembly 20 is inserted into the glass tube 2 in which the electrode 3 and the lead wires 5 and 6 were already attached to one end side and sealed from the other end side of the glass tube 2.

Then, of the two glass beads 13 and 14 of the electrode assembly 20, the glass bead 14 on the inner side of the glass tube 2 and the glass tube 2 are welded and thereby temporarily fastened, thereby presenting the electrode assembly 20 from being dropped inadvertently.

Figure 6C:
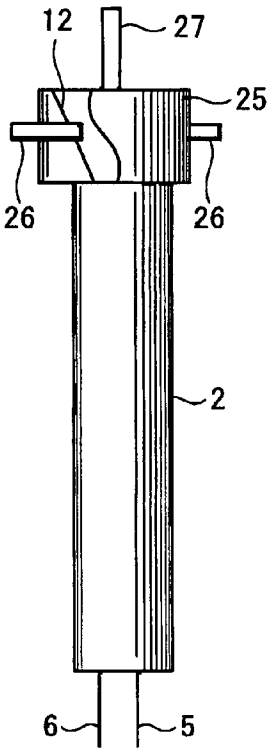

Next, as shown in FIG. 6C, there is prepared a feeding device 25 having two conducting electrodes 26 and an exhaust port 27. This feeding device 25 is mounted on an open end portion of the glass tube 2 and thereby the glass tube 2 is sealed in an air-tight fashion. Also, the two lead wires 11 and 12 are brought in contact with the conducting electrodes 26 of the feeding device 25 and thereby conducted.

Figure 6D:
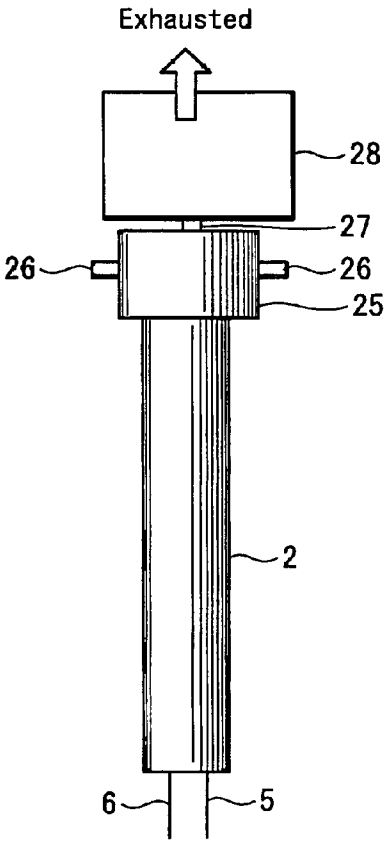

Next, as shown in FIG. 6D, an exhaust device 28 is attached to the exhaust port 27 of the feeding device 25 to exhaust the inside of the glass tube 2.

Figure 6E:
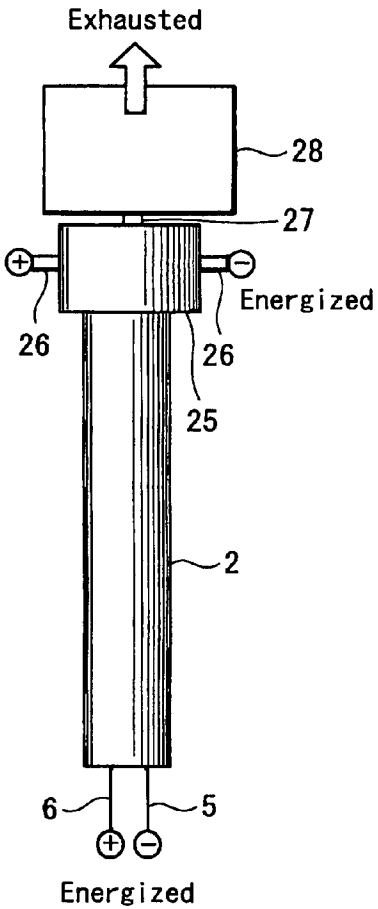
Figure 6J:
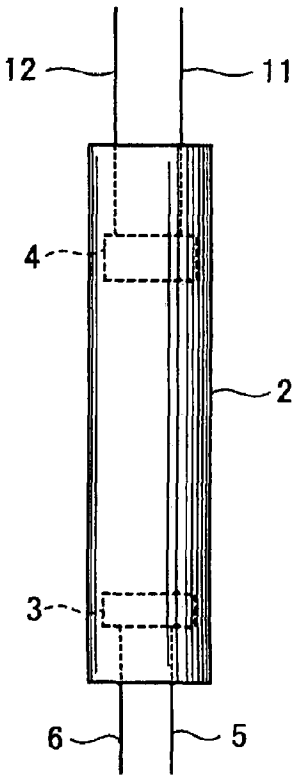

Then, at a time point in which a predetermined degree of vacuum is obtained, the conducting electrodes 26 are energized as shown in FIG. 6E. As a consequence, the electron radioactive material of the electrodes attached to the lead wires 11 and 12 is activated. At that time, with respect to the electrode 3 which has been previously attached to one end side of the glass tube 2, the electron radioactive material on the electrode 3 is activated by conducting the lead wires 5 and 6.

Instead of energizing the conducting electrodes 26, the electrodes 3 and 4 may be heated at a high frequency.

Figure 6I:
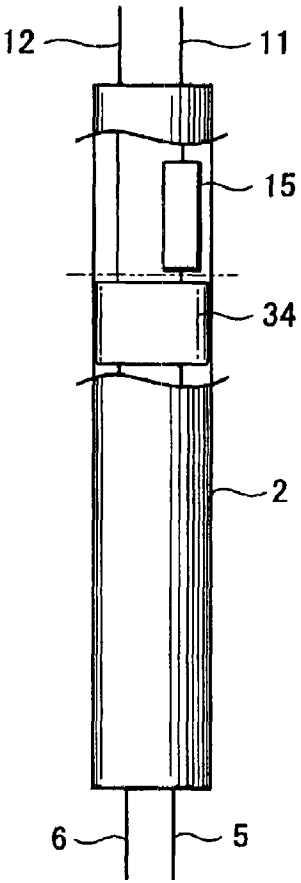
Figure 6H:
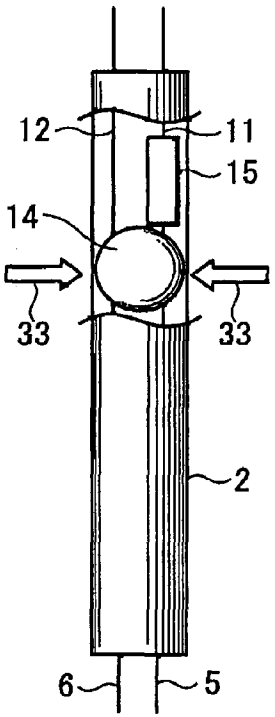
Figure 6G:
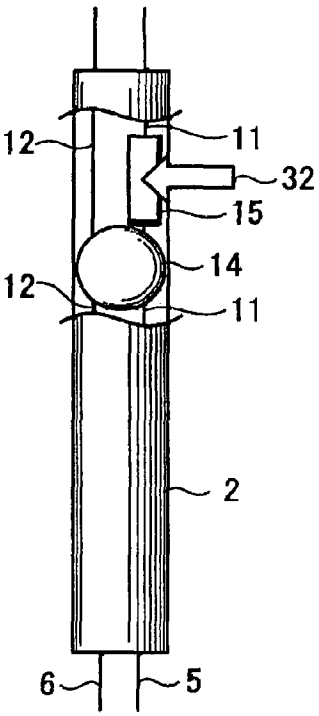
Figure 6F:
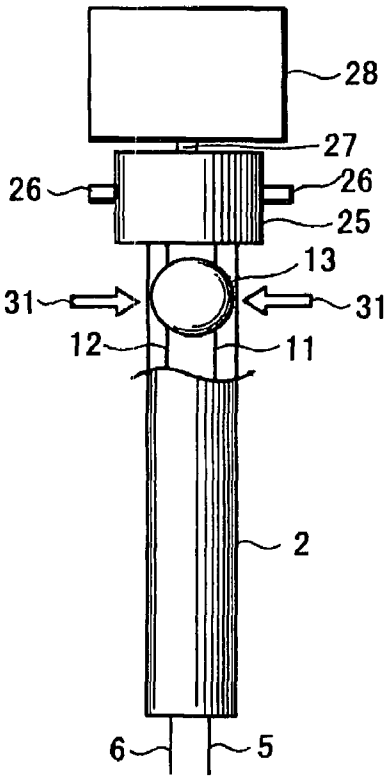

After activation of the electron radioactive material was completed, as shown in FIG. 6F, the inside of the glass tube 2 is sealed by welding the glass bead 13 on the side (end portion side of the glass tube 2) close to the feeding device 25 and the glass tube 2 by heating as shown by open arrows 31 in FIG. 6F.

Thereafter, the exhaust device 28 and the feeding device 25 are removed.

Next, as shown in FIG. 6G, the mercury is evaporated by heating the mercury amalgam 15 by high frequency heating as shown by an open arrow 32. As a consequence, the mercury is diffused into the inside of the glass tube 2 through the gap between the thus temporarily-fastened glass bead 14 and the glass tube 2.

At that time, since the inside of the glass tube 2 is sealed by welding the glass bead 13 and the glass tube 2, the mercury can be prevented from being leaked to the outside of the glass tube 2.

Subsequently, as shown in FIG. 6H, the glass bead 14 on the inner side of the glass tube 2 and the glass tube 2 are welded by heating as shown by open arrows 33 to thereby seal the inside of the glass tube 2.

Finally, as shown in FIG. 6I, the end portion side is cut from a portion 34 sealed by welding the glass bead 14.

In this manner, as shown in FIG. 6I, there can be manufactured the fluorescent lamp 1 shown in FIG. 2.

According to the above-mentioned manufacturing method, there is used the electrode assembly 20 in which the two glass beads 13 and 14 are fixed side by side to the two lead wires 11 and 12 extended from the electrode 4 in the direction extending along the lead wires 11 and 12. Also, since the inside of the glass tube 2 is exhausted after the lead wires 11 and 12 of the electrode assembly 20 were inserted into the glass tube 2, it is possible to exhaust the inside of the glass tube 2 without providing the exhaust pipe.

Accordingly, it is possible to manufacture the fluorescent lamp 1 with the small diameter and which has no exhaust pipe provided thereon.

Also, since the glass bead 13, near the end portion side of the glass tube 2, of the two glass beads 13 and 14 is welded to the glass tube 2 to thereby seal the inside of the glass tube 2 and the mercury is evaporated by heating the mercury amalgam 15, in this state, the mercury amalgam 15 still remains within the thus sealed space.

As a result, although the thus evaporated mercury is entered into the inside of the glass tube 2 from the gap between the other glass bead 14 and the glass tube 2, it can be prevented from being leaked to the outside of the glass tube 2.

Further, of the two glass beads 13 and 14, the inside of the glass tube 2 is sealed by welding the glass bead 14 on the inner side of the glass tube 2, whereby the glass tube 2 can be sealed with high reliability.

Also, by using the feeding device 26 including the conducting electrodes 26 shown in FIG. 6C, it is possible to appropriate a manufacturing apparatus such as the exhaust device 28 which has been used in the related-art cold cathode fluorescent lamp (CCFL).

Separately from the above-mentioned manufacturing method, there may be considered a method in which the lead wire is welded to the glass tube, the glass bead and the glass tube being sealed after mercury was diffused instead of the method in which the electrode assembly in which only one glass bead is welded to the lead wire is temporarily fastened to the glass tube and exhausted, whereafter the glass 13 shown in FIG. 4 is welded.

However, according to this method, the inside of the glass tube may not be kept air-tight sufficiently.

While the electrode 4 and the lead wires 11 and 12 have the arrangements shown in FIG. 3 in the above-mentioned embodiment, the fluorescent lamp according to the present invention is not limited to the arrangement shown in FIG. 3 and it can use various arrangements of the related-art. Also, the present invention is not limited to the arrangement (hot cathode fluorescent lamp) including the electrode 4 shown in FIG. 3 and can be applied to various arrangements such as the cold cathode fluorescent lamp.

Furthermore, the number of lead wires connected to the electrode may be more than three and the number of lead wires to which the mercury amalgam is welded may be more than two.

According to the above-mentioned fluorescent lamp of the present invention, the exhaust pipe has no convex portion provided thereon, the ineffective light emission length of the fluorescent lamp can be decreased, and the ineffective light emission length can be decreased when the fluorescent lamp according to the present invention is applied to a backlight.

Also, since the fluorescent lamp according to the present invention has no exhaust pipe provided thereon, exhaust efficiency can be prevented from being lowered. When a fluorescent lamp is manufactured, the inside of the glass tube can be exhausted in a short period of time and hence productivity can be improved.

Then, it is possible to decrease the diameter of the fluorescent lamp.

Also, according to the manufacturing method of the present invention, since the inside of the glass tube can be exhausted without providing the exhaust pipe, it becomes possible to manufacture the fluorescent lamp having the small diameter.

It should be understood by those skilled in the art that various modifications, combinations, sub-combinations and alterations may occur depending on design requirements and other factors insofar as they are within the scope of the appended claims or the equivalents thereof.

What is claimed is:

1. A method of manufacturing a fluorescent lamp, the method comprising steps of:

using an electrode assembly in which a plurality of lead wires are each directly connected to an electrode, and a first glass bead and a second glass bead are fixed to each of said plurality of lead wires and extended from said electrode in a direction along said lead wires;

welding a mercury amalgam to at least one of said plurality of lead wires between said first and second glass beads;

exhausting an inside of a glass tube after said lead wires of said electrode assembly are inserted into said glass tube;

sealing the inside of said glass tube by welding the first glass bead near an end portion of said glass tube;

evaporating mercury by heating said mercury amalgam; and sealing the inside of said glass tube by welding the second glass bead near the inside of said glass tube.

2. A method of manufacturing a fluorescent lamp according to claim 1, wherein said electrode contains an electron radioactive material and said electron radioactive material of said electrode is activated by conducting said electrode through said lead wires or by heating said electrodes at high frequency when the inside of said glass tube is exhausted.

* * * * *